United States Patent [19]

Walters

[11] 3,999,801

[45] Dec. 28, 1976

[54] BODY CUSHION-RECEIVING SEATING STRUCTURE

[76] Inventor: James Dean Walters, 2401 Somerset Ave., Castro Valley, Calif. 94546

[22] Filed: Oct. 24, 1975

[21] Appl. No.: 625,396

[52] U.S. Cl. ..... 297/445; 297/133; 297/454; 297/456

[51] Int. Cl.[2] ..... A47C 1/12

[58] Field of Search ..... 297/130–133, 297/445, 454–456

[56] References Cited

UNITED STATES PATENTS

| | | | |
|---|---|---|---|
| 875,903 | 1/1908 | Flemming | 297/133 X |
| 3,826,533 | 7/1974 | Andrus et al. | 297/445 |
| 3,899,210 | 8/1975 | Samhammer et al. | 297/445 |

*Primary Examiner*—James C. Mitchel

*Attorney, Agent, or Firm*—Townsend and Townsend

[57] ABSTRACT

A seating structure removably receives a typically amorphous styrofoam pellet-filled body cushion. The seating structure includes a shell for holding the cushion and a pedestal for supporting the shell on a floor surface. In the preferred embodiment the shell has a bottom portion, rear support, side and front portions integral with, and extending generally upward from, said bottom to define a contoured and shaped cushion-receiving cavity. The shell is generally concavo-convex in shape with the pedestal attached to the convex underside of the shell. The pedestal is additionally adapted to removably receive casters or detachable base supports.

11 Claims, 5 Drawing Figures

BODY CUSHION-RECEIVING SEATING STRUCTURE

This invention relates to seating structures and more particularly to a seating structure uniquely designed and constructed for receiving and holding a large amorphous body cushion.

BACKGROUND OF THE INVENTION

There is on the market today body cushions which, in themselves, serve as a seating apparatus. One such body cushion, more commonly referred to as a "Bean Bag", is formed of a plurality of long, narrow panels, typically ranging in length from four feet to eight feet, attached one to the other to form a large bag-like structure. Among the materials used to fill such cushions, the more popular fill is a pellet-shaped expanded synthetic resinous material, manufactured by Dow Chemical Company under the trademark STYROFOAM.

The cushion is filled to approximately 60 percent of its fully capacity, thereby allowing room for the filling to be disposed when the bag receives an occupant. When a person seats himself on the cushion, usually situated on the floor, the styrofoam pellets contained within the cushion dispose themselves, under the weight of the person, to produce an occupant-receiving cavity.

While such body cushions are convenient and inexpensive, their use is not without certain difficulties. For example, very little support is provided the occupant who wishes to sit in a relatively upright sitting position. If the user leans back, the pellets in the bag behind the user will dispose themselves to the side so that the user winds up in a substantially horizontal position. Moreover, as the pellets are disposed the user sometimes will roll off one side of the body cushion.

Since such body cushions are usually used on a floor, this low position makes it difficult for persons to get up from such cushions. This difficulty is amplified by the lack of any supporting structure associated one may utilize to rise from a sitting position.

Finally, when the cushion is occupied, the enclosed styrofoam pellets are disposed outward against the cushion cover under the weight of an occupant. This outward disposition of pellets tends to place a substantial strain upon the seams of the cushion. After much use, the seams begin to tear under the strain. Moreover, continually dragging the cushion over the floor from one position in a room to another position contributes to the wear and tear. Thus, the useful lifespan of such body cushions are not as long as they could be.

SUMMARY OF THE INVENTION

The present invention provides a seating structure for receiving such body cushions as described above to overcome the aforementioned problems. According to the present invention, the seating structure comprises a unitary upwardly concave-shaped shell having bottom, front, side and back portions defining a concavity to removably receive and retain a body cushion. Attached to the outer convex surface of a shell is a rectangular flat-bottomed pedestal for supporting the shell on a floor. Additionally, the pedestal is adapted to interchangeably receive a variety of base members, such as casters, that provide the seating structure with rolling, rocking, or even swivel capability, depending upon the type of base member used.

The use of the seating structure disclosed herein, in conjunction with a body cushion, achieves many advantages not obtained by use of such a body cushion alone. First, an occupant is now furnished with sufficient back, neck, and head support provided by the raised back of the shell of this invention. An occupant leaning back now has back and head support so that he need not hold his head upright to watch television, carry on a conversation, or the like. Use of the seating apparatus and body cushion allow an occupant to recline while his head remains supported in a generally upright position. Moreover, the support provided by the sides, back, and front portions of the shell obviate the problem of rolling out of the cushion normally experienced when using the cushion alone.

Since the cushion, when situated in the seating structure, is now raised from the floor, an occupant now finds it easier to rise from a sitting position. Moreover, the seating structure itself provides support to additionally facilitate rising.

The overall support provided the cushion by the cavity of the shell alleviates much of the strain on the seams of the cushion cover thereby lengthening the useable lifespan of the cushion in that respect.

For a better understanding of the present invention, together with other and further features thereof, reference is had to the following description taken in connection with the accompanying drawings, the scope of the invention being pointed out in the appended claims.

BRIEF DESCRIPTION OF THE DRAWINGS

Referring to the drawings.

DETAILED DESCRIPTION OF THE PREFERRED EMBODIMENT

Figure 1:
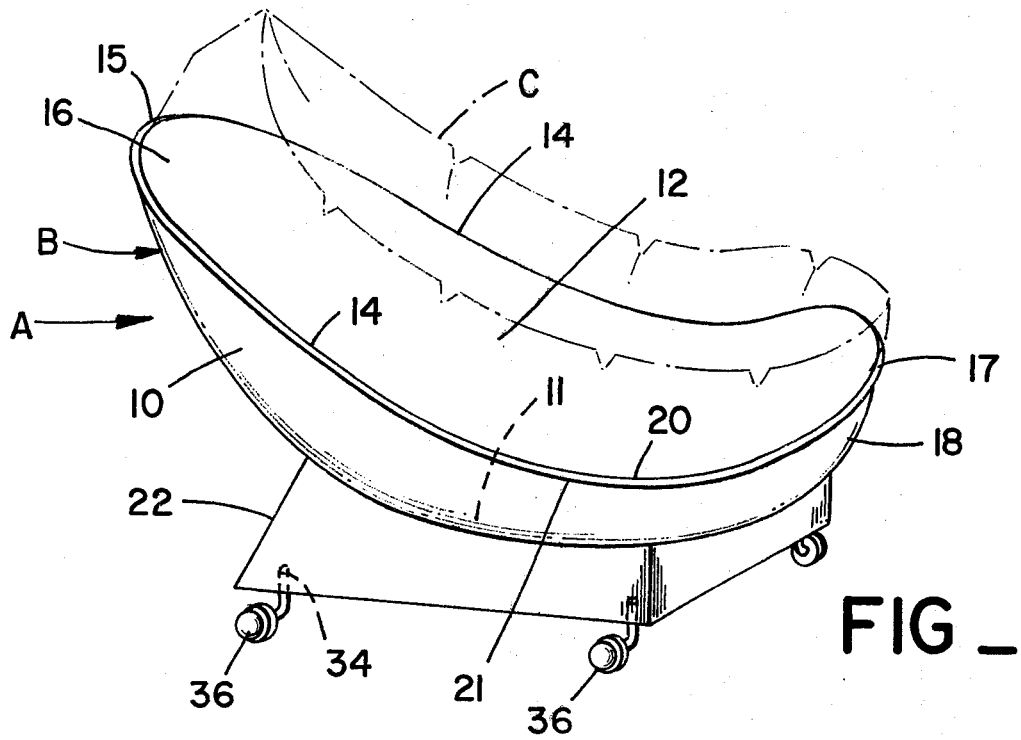
FIG. 1 is a perspective view of the seating apparatus of the present invention and illustrating, in phantom, a body cushion contained therein.
Figure 2:
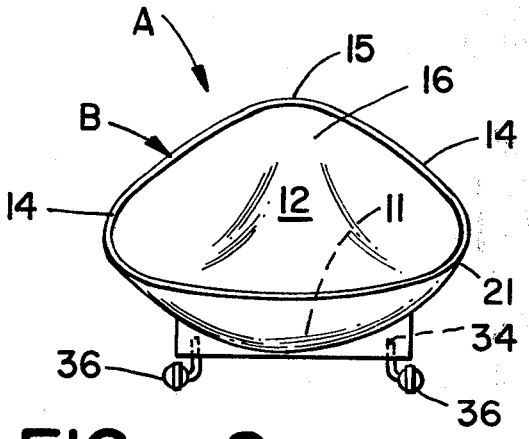
FIG. 2 is a front elevation of the invention illustrated in FIG. 1.

Referring now to FIGS. 1 and 2, there is shown a body cushion-receiving unitary seating structure A, according to the present invention. Seating structure A includes shell B and integral support pedestal 22. Seating structure A is preferably but not necessarily of one piece construction. Shell B has an outer convex surface 10 and an inner cavity 12 formed by integrally joining bottom portion 11, side portions 14, 14, front portion 18, and back portion 16.

Figure 3:
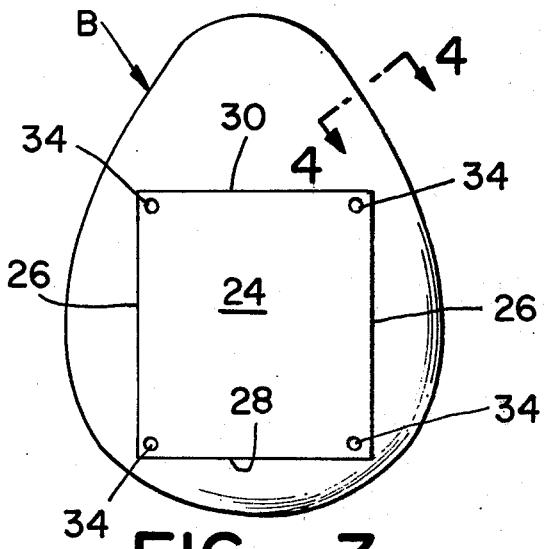
FIG. 3 is a bottom view of the seating structure of this invention.

Referring to FIGS. 1–3 the shape of shell B may now be geometrically described. Surface 10 is first generated by rotating one-half of an ellipse approximately 180° about its major axis. One end of the elliptic surface generated is truncated to form the front portion 18. Sides 14, 14 are created by cutting away the longitudinal side edges of the elliptic surface in a generally upward sloping parabolic path from front portion 18 to back portion 16. Thus, generically speaking, a truncated, elliptic concavo-convex shell, shell B, is thereby created.

Referring now specifically to FIG. 1, the functional relationship between the shape and dimensions of the shell and the body cushion it receives will now be described. As can be seen, body cushion C (shown in phantom), when placed in shell B, will generally assume the concave shape of the cavity 12. In order to obviate abrasive contact between the back of the neck or head of an occupant and edge 15 of back portion 16, the body cushion must extend somewhat above edge 15, as shown in phantom in FIG. 1. It follows, therefore, that the arcuate contour along shell B from front portion 18 to edge 15 of back portion 16, to which the body cushion will generally conform, must be of a length less than the length of body cushion C when inserted in shell B. This will allow body cushion C to be so situated in shell B so that when one is seated in structure A the cushion is positioned between the head or neck of the occupant and edge 15.

In order that an appropriately sized cushion C is positioned to come between an occupant and edge 15, front portion 18 is provided. Front portion 18 extends up from bottom 11 to provide a front retaining wall to hold cushion C so that the cushion extends above edge 15 of back 16. Moreover, front portion 18 also functions to insure that body cushion C is retained within cavity 12 of shell B and does not slide out. While front portion 18 must extend up sufficiently high from bottom 11 to perform these retaining functions, it must be sufficiently shallow to position an occupant's legs above front edge 17 to avoid abrasive contact therewith.

Thus, as shown in FIG. 1, the height of front portion 18 is preferably sufficient to retain cushion C within cavity 12 of shell B in a position that places the cushion between an occupant and edge 15. Additionally, cushion C is preferably of such thickness, with relation to the height of front portion 18, that the legs of an occupant are held above, and out of contact with, front edge 17.

Side portions 14, 14 act to laterally retain body cushion C. The arcuate contour formed by side portions 14, 14 is constructed to have a path measured from circumferential edge 20 on one side portion to the opposite side portion, length less than the transverse arcuate contour attained by cushion C when disposed in cavity 12 of shell B. When situated in shell B, the edges of body cushion C will be disposed above circumferential edge 20. Thus, abrasive contact between circumferential edge 20 on side portions 14, 14 are alleviated.

In the preferred embodiment, therefore, edge 17 of front portion 18 is 6 inches vertically above a horizontal plane tangent to bottom portion 11. Edge 15 of back portion 16 is vertically 24 inches above a horizontal plane tangent to bottom 11. The circumferential edge 20 of shell B has a maximum transverse width of 36 inches. The horizontal distance from edge 15 of back portion 16 to edge 17 of front portion 18 (FIG. 3) is preferably 48 inches.

Floor-engaging support is provided shell B by pedestal 22 which is integral to the outer convex bottom of shell B. Pedestal 22 has front section 28, back section 30 and side sections 26, 26 defining a generally rectangular, flat, floor-engaging surface 24 that is shown in FIG. 3.

Preferably, shell B, including pedestal 22 integral therewith, is mass-produced using injection molding techniques with an appropriate thermoplastic material. It is preferred that the unitary setting structure A be formed of a yieldable resilient material. Therefore, a plastic material such as polyethylene should have either a low or medium density or whatever density is necessary in order to produce the yieldable resilient characteristics.

Figure 4:
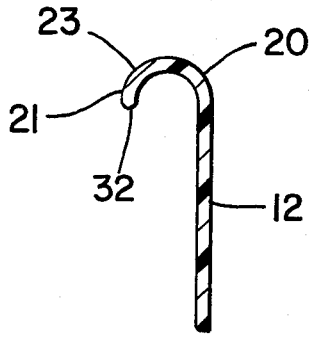
FIG. 4 is a cross-sectional view taken along lines 4—4 of FIG. 3.

As illustrated in FIGS. 1–3, shell B of seating structure A has circumferential edge portion 20 that is provided with rolled lip 21. Referring specifically to FIG. 4, it can be seen that rolled lip 21 is defined by rolling circumferential edge 32 of shell B outwardly from cavity 12 to form arcuate bend 23. It is preferred that arcuate bend 23 be somewhat semi-circular and have a diameter of approximately 1 inch to provide a rolled edge on seating structure A that may easily be grasped for lifting or moving purposes. Rolled lip 21 of circumferential edge portion 20, in addition to providing grasping apparatus, also inhibits the formation of cracks, splits, or the like, which has been found to happen when circumferential edge portion 20 of shell B is defined without a roll by edge 32.

As pointed out above, the flat-bottom surface 24 of pedestal 22, without anything more, sufficiently allows the unitary seating structure A, comprising shell B and pedestal 22, to be used on any type of flat, level surface. However, in the event it is desired that seating structure A have rolling, rocking, or other capabilities, pedestal 22 is adapted to removably receive a variety of base members. Referring specifically to FIG. 3 there is shown, in each corner of bottom surface 24 of pedestal 22, sockets 34. Generally cylindrical in geometric shape, sockets 34 extend longitudinally into pedestal 22, normal to bottom pedestal surface 22, to a depth of approximately 4 inches. The diameter of sockets 34 is preferably sufficient to provide a slidably snug receptable for removably engaging and retaining such base members as casters 36 (FIGS. 1 and 2) or rocker base 40 (FIG. 5), described below.

Figure 5:
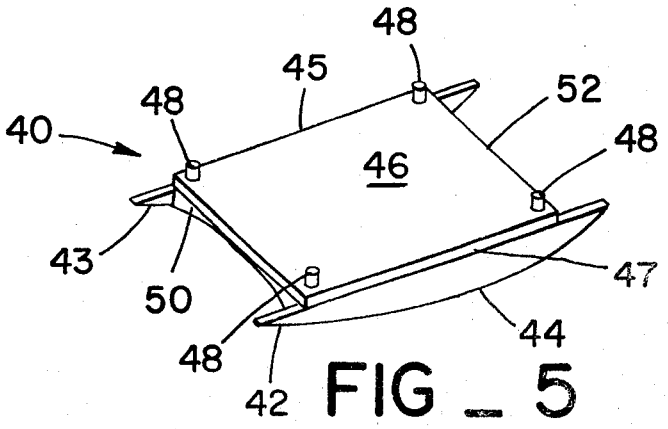
FIG. 5 is a perspective view of a detachable base for use with the present invention.

Referring now to FIG. 5, base member 40 is shown which may be used interchangeably with casters 36. Base member 40 comprises support member 46 with rocker members 42 and 43 securely connected to sides 45 and 45 of the support member. Lateral support is provided rocker members 42, 42 by front and rear lateral support struts 50 and 52, respectively. Each rocker section 42 has an arcuate portion 44 which, when base member 40 is attached to pedestal 22, provides a rocker action for the seating structure A. Socket posts 48 are positioned upon and securely connected to support member 46 so that they may removably engage sockets 34 situated in the pedestal 22.

Socket posts 48 are perpendicular to support member 46, generally cylindrical in shape, and preferably less than 4 inches in length. Their diameter is such that when fitted in sockets 34 of seating structure A a removably slidable snug fit is obtained.

Since seating structure A is preferably constructed from a lightweight plastic, it can easily be lifted, placed upon base member 40, after lining up socket posts 48 to sockets 34, and slight downward pressure applied to seat the socket posts in their respective sockets 34. Alternately, seating structure A can be removed from base member 40 and be used alone or have casters 36 inserted in each of sockets 34.

In use, body cushion C, such as the styrofoam pellet-filled body cushion described above, is placed in cavity 12 of shell B (FIGS. 1 and 2). A person occupies cushion C and in so doing generates a cavity in the cushion that generally conforms to his body. Further, back support is provided the occupant by back portion 16 of shell B. The occupant may recline while still remaining in substantially an upright sitting position. Moreover, cushion C, and therefore the occupant therein, is supported at the sides by side portions 14 which prevent an occupant from rolling out of the cushion, which is possible when sitting in the cushion C alone.

The subject invention provides a convenient, simple, and comfortable seating structure that is inexpensive to manufacture and easy to use. While a preferred embodiment of the present invention has been illustrated in detail, it is obvious that modifications and adaptations of that invention will occur to those skilled in the art. For example, the seating structure disclosed herein has been shown with a pedestal adapted to set directly on a floor or to accept such floor-engaging apparatus as casters or rocker-type base member. Alternatively, a swivel base may be provided to removably fit onto the pedestal 22. However, it is to be expressly understood that such modifications and adaptations are within the spirit and scope of the present invention, as set forth in the following claims.

What is claimed is:

1. A seating structure for removably retaining an amorphous occupant-receiving body cushion of the type having a predetermined length generally extending from a position under each leg of an occupant to a back and head supporting position behind the occupant, comprising:

a shell for receiving the body cushion and including a bottom portion, a front portion connected to a front margin of said bottom portion and extending upwardly therefrom terminating in a first edge, a rear portion connected to a rear margin of said bottom portion and extending upwardly therefrom terminating in a second edge vertically higher than said first edge, an upwardly extending side portion connected to each side, respectively, of said bottom portion, said front, rear and side portions being integral with said bottom portion to define a continuous cushion-supporting upper surface to position the cushion between an occupant situated therein and said shell and to confine and to support the cushion in said shell to prevent movement of the cushion out of said shell under the weight of the occupant, said front portion having a height sufficient to impede forward movement of the cushion out of the shell; and pedestal means connected to said shell for supporting the same on a floor surface.

2. The seating structure of claim 1, and including:

a floor-engaging base support coupled to said pedestal means; and retaining means connected to said pedestal means for removably holding said base support.

3. The seating structure of claim 2, wherein said base support comprises:

a plurality of casters.

4. The seating structure of claim 2, wherein said base support includes:

an arcuate floor-engaging bottom.

5. A seating structure for receiving and seating an occupant therein, comprising:

a body cushion for receiving and conforming to the shape of the occupant in a sitting position;

an upwardly concave-shaped shell for receiving said body cushion and including a bottom portion, a front portion connected to a front margin of said bottom portion and terminating substantially vertically upward therefrom at a first edge, a rear portion connected to a rear margin of said bottom portion and extending upwardly therefrom terminating in a second edge vertically higher than said first edge, an upwardly extending side portion connected to each side margin, respectively, of said bottom portion and extending between said front portion and said back portion, said front, rear, side and bottom portions defining a continuous cushion-supporting upper surface to position said cushion between the occupant situated therein and said shell and to confine said cushion to said shell to prevent movement of said cushion under weight of the occupant out of said shell, said cushion having a height with respect to said first edge sufficient to hold the legs of said occupant out of contact with said first edge when said occupant is seated in the cushion;

pedestal means connected to said shell for supporting the same; and floor-engaging means connected to said pedestal for supporting said seating structure from a floor surface.

6. The seating structure of claim 5, and including:

a surface distance from front portion to said second edge less than said predetermined length of said cushion so that the neck and head of the occupant are held out of contact with said second edge.

7. The seating structure of claim 6, and wherein:

said side portions having a height with respect to said cushion to laterally maintain said cushion between said front and rear portions.

8. The seating structure of claim 1 wherein said second edge of said back portion is disposed at least 12 inches vertically higher than said first edge of said front portion.

9. The seating structure of claim 5, wherein said floor-engaging means is removable and said pedestal has a lower surface for engaging the floor.

10. The seating structure of claim 9, wherein said floor-engaging means comprises:

a plurality of casters.

11. The seating structure of claim 9, wherein said floor-engaging means includes:

an arcuate bottom for engaging the floor surface.

* * * * *